US006599162B2

(12) United States Patent
Huset

(10) Patent No.: US 6,599,162 B2
(45) **Date of Patent: *Jul. 29, 2003**

(54) CIRCULAR FLYING DISK TOY

(75) Inventor: Lawrence Huset, 2208 State Ave., Apt. B, Costa Mesa, CA (US) 92627

(73) Assignee: Lawrence Huset, Costa Mesa, CA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/476,259

(22) Filed: Jan. 3, 2000

(65) Prior Publication Data

US 2002/0045399 A1 Apr. 18, 2002

(51) Int. Cl.[7] ..... A63H 27/00
(52) U.S. Cl. ..... 446/46; 473/588
(58) Field of Search ..... 446/46–48, 61, 446/67, 66, 247, 248, 249, 250, 236, 233, 235, 253; 473/588, 589; 273/DIG. 29

(56) References Cited

U.S. PATENT DOCUMENTS

| | | | | | |
|---|---|---|---|---|---|
| 29,055 | A | * | 7/1860 | Brown | 301/63.1 |
| 3,158,404 | A | * | 11/1964 | Noakes | 301/64.7 |
| 3,566,532 | A | * | 3/1971 | Wilson | 446/46 |
| 3,784,204 | A | * | 1/1974 | Felber | 473/588 |
| 4,112,612 | A | * | 9/1978 | Woods | 446/46 |
| 4,253,269 | A | * | 3/1981 | Sullivan | 446/46 |
| 4,356,660 | A | * | 11/1982 | O'Brien | 446/46 |
| 4,940,441 | A | * | 7/1990 | Novinsky | 446/46 |
| 4,986,790 | A | * | 1/1991 | Boury | 446/219 |
| 5,127,390 | A | * | 7/1992 | Paulson | 152/323 |
| 5,512,028 | A | * | 4/1996 | Sparks, III | 446/253 |
| 5,816,965 | A | * | 10/1998 | Kotler | 473/588 |
| 6,113,453 | A | * | 9/2000 | Stuffelbeam | 446/46 |

* cited by examiner

*Primary Examiner*—Kien T. Nguyen
*Assistant Examiner*—Urszula M. Cegielnik

(57) ABSTRACT

A flying toy including a cylindrical rim and a flat circular airfoil located within the rim. The centerline of the airfoil is positioned to bisect the side surface of the rim, resulting in a flying toy of increased stability and throwing ease.

1 Claim, 2 Drawing Sheets

CIRCULAR FLYING DISK TOY

BACKGROUND OF THE INVENTION

1. Field of the Invention

The subject invention relates generally to toys and amusement devices and more particularly to an aerodynamic disk consisting of a circular center airfoil centered within a circular outer rim or ring.

2. Description of Related Art

Flying saucer devices, or so-called "frisbees," are known in the prior art. Such devices have been used as throwing implements or toys, typically in games of "catch." Such devices typically employ a central disk portion and a rim extending downwardly from and circumscribing the central disk, for example, as disclosed in U.S. Pat. No. 3,359,678.

SUMMARY OF THE INVENTION

The invention provides a flying toy including a cylindrical rim having a circular top edge running parallel to a circular bottom edge; and a flat circular central airfoil having a circular edge and a horizontal center line, the circular edge being attached to the inner circumference of the rim such that the centerline of the airfoil bisects the side surface of the rim. When thrown as a flying disk, the device provides increased gyroscopic effect and stability.

BRIEF DESCRIPTION OF THE DRAWINGS

The just summarized invention will now be described in detail in conjunction with the drawings of which.

DETAILED DESCRIPTION

Figure 1:
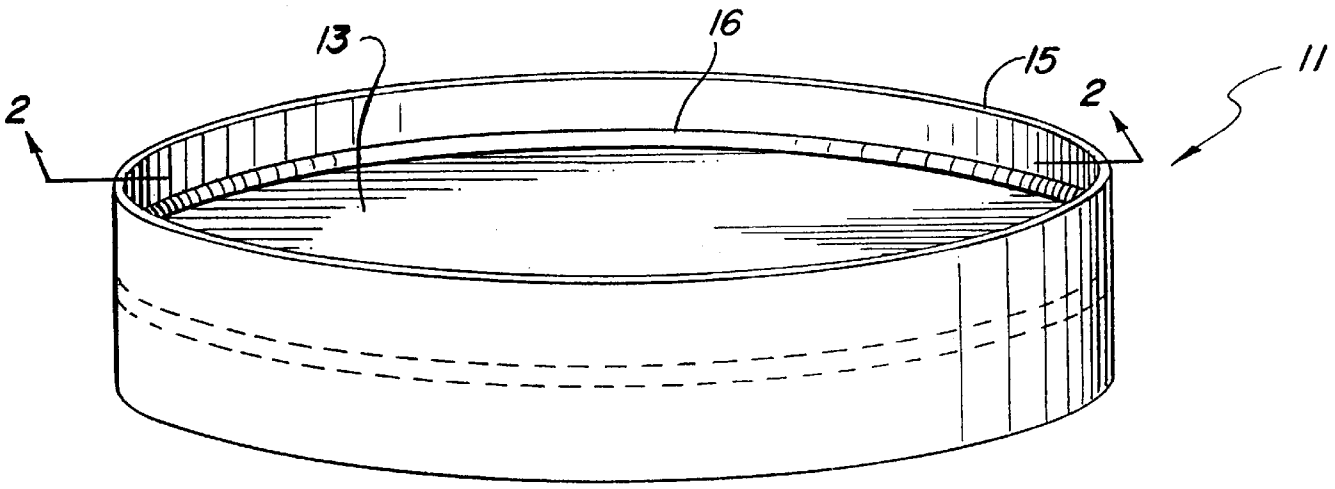
FIG. 1 is a perspective view of a first embodiment of the invention.
Figure 2:
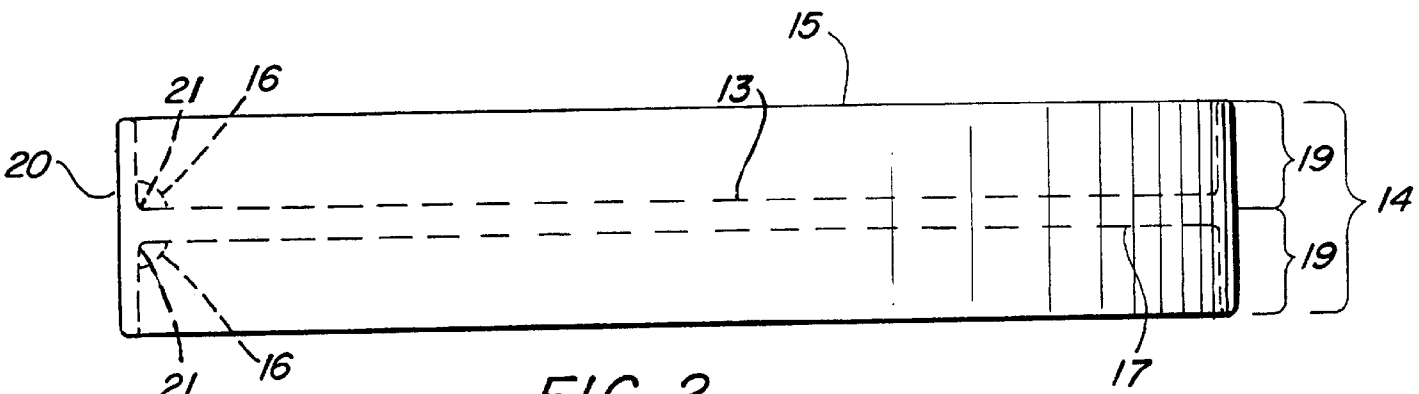
FIG. 2 is a sectional view taken at 2—2 of FIG. 1.

A prototype flying disc toy 11 according to a preferred embodiment is shown in FIGS. 1 and 2. The center circular portion or airfoil 13 of this disc toy 11 is planar, constructed of foam board about 3/16 inches thick, and can vary in diameter, e.g., between 5 inches to 12 inches in diameter. The outer ring 15 is cylindrical, comprised of posterboard about 5/64 inches thick, and may vary in height from 1 inch to 2 inches in correlation to the size of the center circular portion.

The outer ring 15, after it is cut to proper specifications, is positioned around the center airfoil 13 and attached at a 90-degree angle with a glue gun or other adhesive. The outer ring 15 is attached to the center airfoil 13 such that the center line 17 of the airfoil 13 bisects the side surface 20 so that equal portions 19 of the side surface 20 extend to each side of center line 17. For a 10" diameter disc, the side portions 19 may each be ¾". As a result, the top and bottom of the device 11 are mirror images of one another.

After the outer ring 15 is attached to the center airfoil 13, silicone is applied over the perimeter of seams 21, or "equatorial line," where the outer ring 15 connects to the center airfoil 13. The silicone is smoothed evenly around the entire circumference on both sides so that both sides, have a smoothed layer of silicone with a radius at about ⅛ inch where the center airfoil 13 and outer ring 15 connect. This treatment increases the circumferential weight at the outer ring 15, increasing the gyroscopic effect tending to level the disc in flight.

The height of the ring 15 in relation to the diameter of the center horizontal airfoil 13 determines distance performance. Thus, for example, with a center horizontal airfoil diameter of 8", use of a vertical rim height 14 of 1½" results in substantially more air resistance than a vertical rim height of 1¼". A ratio of diameter versus height of rim could vary from a ratio of 5:1 to a ratio of 8:1 without significantly effecting performance. Only the distance of flight is affected by this ratio. Greater height of the outer vertical rim results in more air caught between the airfoil and the outer rim, thus resulting in a more pronounced floating effect.

Figure 3:
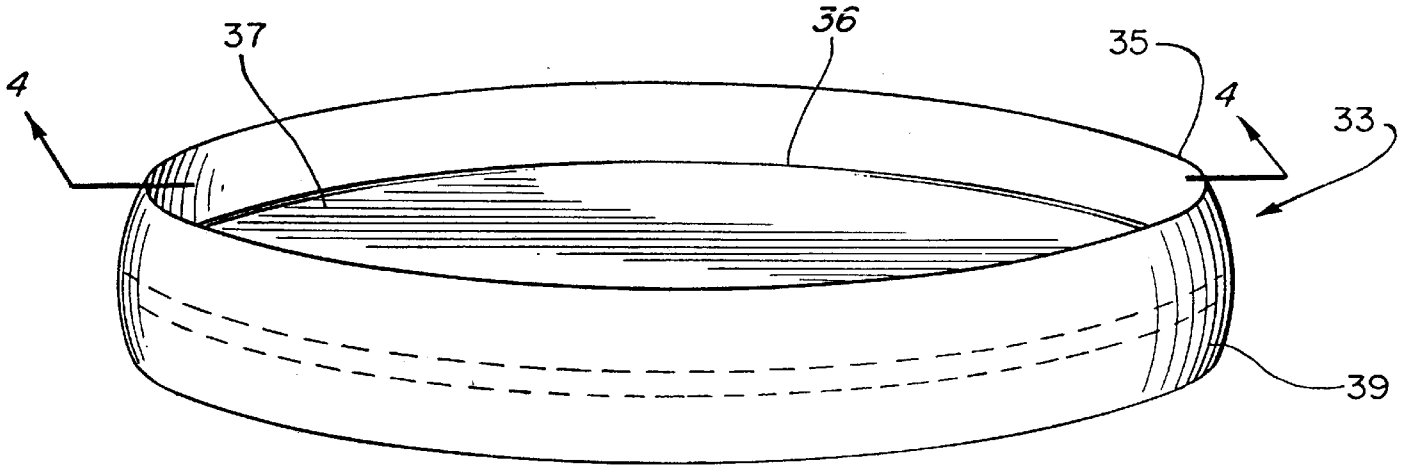
FIG. 3 is a perspective view of a second embodiment.
Figure 4:
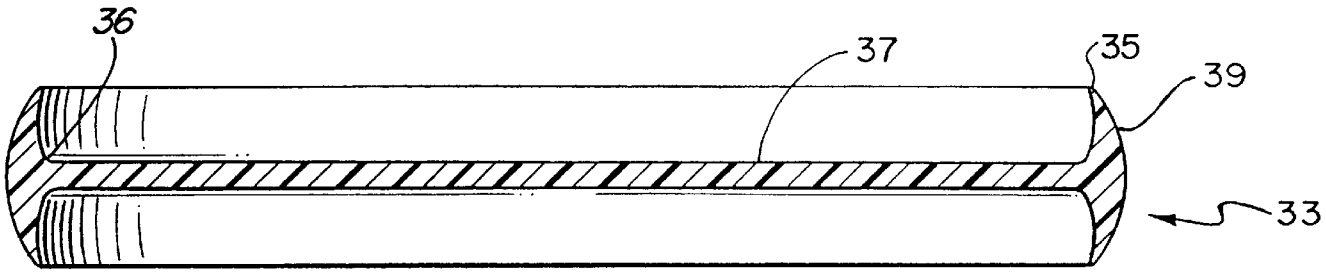
FIG. 4 is a sectional view taken at 3—3 of FIG. 3.

For production purposes, it is presently preferred to fabricate a flying disc 33 (FIGS. 3 and 4) by a plastic injection molding process. The result is a molded plastic body including a flat center airfoil 37 bounded about its perimeter by a rim portion 35 extending an equal distance on each side of the center airfoil 37. The rim portion 35 is at a 90-degree angle to the airfoil 37 for the entire circumference of center airfoil. Circumferential weight 36 in the form of extra material at the outer ring 35, where the center airfoil 37 connects to the outer rim 35 is added as needed during the injection molding process. The outer surface 39 of the rim portion 35 curves upwardly and downwardly from the center airfoil 37 enabling manual projection from either of the two identical sides.

The device 33 is thus shaped to provide a body having an aerodynamic airfoil profile, such that when it is flung through the air with a spinning motion, it appears to sail, or "float," through the air. The spinning motion imparted by a wrist-flick gyroscopically stabilizes the flight.

Devices such as those disclosed in FIGS. 1–4 may be thrown by the user in a backhanded motion with one hand, keeping the arm parallel with the ground, and ending the throw with a snapping motion of the wrist. Variations of the angle of the arm at launch determine the angle of flight relative to altitude and direction.

The disclosed devices 11, 33 are easier to throw and catch due to their shape, levelness, and the effect of "floating" toward the receiving individual, rather than being "whipped" toward that individual. Children adapt to the device more quickly and easily, due to the steadiness of the flight and the ability to toss the device along a more level path and at a shorter range. Such devices can also be thrown in areas that previously did not lend themselves to this activity because such devices can be comfortably thrown at a closer range than those of the prior art, which is especially important in densely populated areas. Thus, a large span of playing field is unnecessary, and a device as disclosed can be comfortably used in an average-sized yard. It is also impossible for the device to be upside-down when thrown since both the top and bottom are identical.

Those skilled in the art will appreciate that various adaptations and modifications of the just-described preferred embodiments can be configured without departing from the scope and spirit of the invention. Therefore, it is to be understood that within the scope of the appended claims, the invention may be practiced other than as specifically described herein.

What is claimed is:

1. A flying toy comprising:

a circular center airfoil having a fixed diameter, an outer edge, a top surface, and a bottom surface, the top surface being planar and flat, the bottom surface being planar and flat and spaced from the top surface by a fixed distance parallel to the top surface;

a cylindrical rim having a diameter equal to the diameter of the circular center airfoil fastened to the circular center airfoil at the outer edge of the circular center airfoil, the cylindrical rim having a vertical height that extends beyond the top surface and bottom surface of the circular center airfoil by equal amounts and having a thickness that is no greater than the fixed distance between the top and bottom surface of the circular center airfoil; and weighting means at the intersection of the circular center airfoil and the cylindrical rim for increasing the weight of the toy at the intersection of the airfoil and the rim.

* * * * *